US005462326A

United States Patent [19]

Doherty

[11] Patent Number: 5,462,326

[45] Date of Patent: Oct. 31, 1995

[54] APPARATUS FOR RETRIEVING BASEBALLS

[76] Inventor: Scott W. Doherty, 16650 Greenwood Ave., South Holland, Ill. 60473

[21] Appl. No.: 314,089

[22] Filed: Sep. 28, 1994

[51] Int. Cl.[6] ..... A63B 47/02

[52] U.S. Cl. ..... 294/1.1; 294/19.2

[58] Field of Search ..... 294/1.1, 19.2, 294/66.1, 66.2, 99.1; 43/17.2, 44.9, 44.91, 44.97

[56] References Cited

U.S. PATENT DOCUMENTS

| | | | |
|---|---|---|---|
| 2,097,536 | 11/1937 | Shirk | 43/17.2 |
| 2,140,724 | 12/1938 | Stefan | 43/44.9 |
| 3,097,373 | 7/1963 | Wisti | 43/44.9 X |
| 3,141,696 | 7/1964 | Nau | 294/19.2 |
| 3,550,303 | 12/1970 | Western | 294/66.1 X |
| 3,756,644 | 9/1973 | Rydberg | 294/19.2 X |
| 4,021,068 | 5/1977 | Piazza | 294/19.2 |
| 4,610,104 | 9/1986 | Garcia | 43/44.9 X |

*Primary Examiner*—Dean Kramer

[57] ABSTRACT

An apparatus for retrieving baseballs, comprising a cup. The cup has a base with a periphery and a frustro-conical side wall secured to the periphery to thereby form a closed smaller end and an opened larger end. The cup is fabricated of a material with limited resilience whereby the side wall forms an angle when measured from the axis of the cup, such measurements being plus or minus 10 percent. The cup is formed with a small aperture in the center of the base. A string which has a free end positioned through the aperture in the cup when inverted and a knot formed in the free end within the cup. The string also has a secured end. Further provided is a cylindrical handle for the wrapping of the string. The wrapping of the string begins with the secured end and an intermediate extent thereof for feeding out string to allow the free end of the string, the knot and cup to be lowered by gravity over a baseball and then re-wrapped on the handle for retrieving the cup and baseball.

2 Claims, 4 Drawing Sheets

APPARATUS FOR RETRIEVING BASEBALLS

BACKGROUND OF THE INVENTION

1. Field of the Invention

The present invention relates to an apparatus for retrieving baseballs and more particularly pertains to retrieving baseballs through a cup sized to frictionally grasp a baseball and a string to lift the cup and grasped ball for retrieval purposes.

2. Description of the Prior Art

The use of devices for retrieving objects of a wide variety of designs and configurations is known in the prior art. More specifically, devices for retrieving objects of a wide variety of designs and configurations heretofore devised and utilized for the purpose of grasping articles through mechanical devices and moving such grasped articles through various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,485,398 to Offner a tennis ball pick-up and collecting machine.

U.S. Pat. No. 4,157,141 to Ryan discloses a golf ball pick-up apparatus.

U.S. Pat. No. 4,819,938 to Hill discloses a golf ball and tee placement and retrieval tool.

U.S. Pat. No. 5,184,859 to Nihra et al discloses a golf ball retriever.

Lastly, U.S. Pat. No. 5,188,409 to Forey discloses a golf ball retriever.

In this respect, the apparatus for retrieving baseballs according to the present invention substantially departs from the conventional concepts and designs of the prior art, and in so doing provides an apparatus primarily developed for the purpose of capturing and retrieving baseballs through a cup sized to frictionally grasp a baseball and a string to lift the cup and grasped ball for retrieval purposes.

Therefore, it can be appreciated that there exists a continuing need for a new and improved apparatus for retrieving baseballs which can be used for capturing and retrieving baseballs through a cup sized to frictionally grasp a baseball and a string to lift the cup and grasped ball for retrieval purposes. In this regard, the present invention substantially fulfills this need.

SUMMARY OF THE INVENTION

In view of the foregoing disadvantages inherent in the known types of devices for retrieving objects of a wide variety of designs and configurations now present in the prior art, the present invention provides an improved apparatus for retrieving baseballs. As such, the general purpose of the present invention, which will be described subsequently in greater detail, is to provide a new and improved apparatus for retrieving baseballs apparatus and method which has all the advantages of the prior art and none of the disadvantages.

To attain this, the present invention essentially comprises a new and improved apparatus for retrieving baseballs comprising, in combination, a cup. The cup has a base with a periphery and a frustro-conical side wall secured to the periphery, to thereby form a closed smaller end and an opened larger end. The cup is fabricated of a plastic material with limited resilience and with a diameter at the base of three inches, a diameter at the open end of four inches, and a height of about six inches whereby the side wall forms an angle of about five degrees when measured from the axis of the cup. Such measurements are plus or minus 10 percent. The cup is formed with a small aperture in the center of the base. Further provided is a string which has a free end positioned through the aperture in the cup when inverted and a knot formed in the free end within the cup. The string also has a secured end. Also provided is a cylindrical handle for the wrapping of the string. The wrapping of the string begins with the secured end and an intermediate extent thereof for feeding out string to allow the free end of the string, the knot and cup to be lowered by gravity over a baseball and then re-wrapped on the handle for retrieving the cup and baseball. Further provided is a weight which has a hole therethrough positioned in proximity to the small aperture of the cup within the cup whereby lifting the string will cause the string to engage the hole in the weight to lift the weight and the cup. Lastly provided are a plurality of disk-shaped washers with circular openings therethrough positioned between the weight and the base of the cup.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for retrieving baseballs which has all the advantages of the prior art devices for retrieving objects of a wide variety of designs and configurations and none of the disadvantages.

It is another object of the present invention to provide a new and improved apparatus for retrieving baseballs which may be easily and efficiently manufactured and marketed.

It is a further object of the present invention to provide a new and improved apparatus for retrieving baseballs which is of a durable and reliable construction.

An even further object of the present invention is to provide a new and improved apparatus for retrieving baseballs which is susceptible of a low cost of manufacture with regard to both materials and labor, and which accordingly is then susceptible of low prices of sale to the consuming public, thereby making such devices for retrieving objects of a wide variety of designs and configurations economically available to the buying public.

Still yet another object of the present invention is to provide a new and improved apparatus for retrieving baseballs which provides in the apparatuses and methods of the prior art some of the advantages thereof, while simultaneously overcoming some of the disadvantages normally associated therewith.

Still another object of the present invention is to capture and retrieve baseballs through a cup sized to frictionally grasp a baseball and a string to lift the cup and grasped ball for retrieval purposes.

Lastly, it is an object of the present invention to provide a new and improved apparatus for retrieving baseballs, comprising a cup. The cup has a base with a periphery and a frustro-conical side wall secured to the periphery to thereby form a closed smaller end and an opened larger end. The cup is fabricated of a material with limited resilience whereby the side wall forms an angle when measured from the axis of the cup, such measurements being plus or minus 10 percent. The cup is formed with a small aperture in the center of the base. A string which has a free end positioned through the aperture in the cup when inverted and a knot formed in the free end within the cup. The string also has a secured end. Further provided is a cylindrical handle for the wrapping of the string. The wrapping of the string begins with the secured end and an intermediate extent thereof for feeding out string to allow the free end of the string, the knot and cup to be lowered by gravity over a baseball and then re-wrapped on the handle for retrieving the cup and baseball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
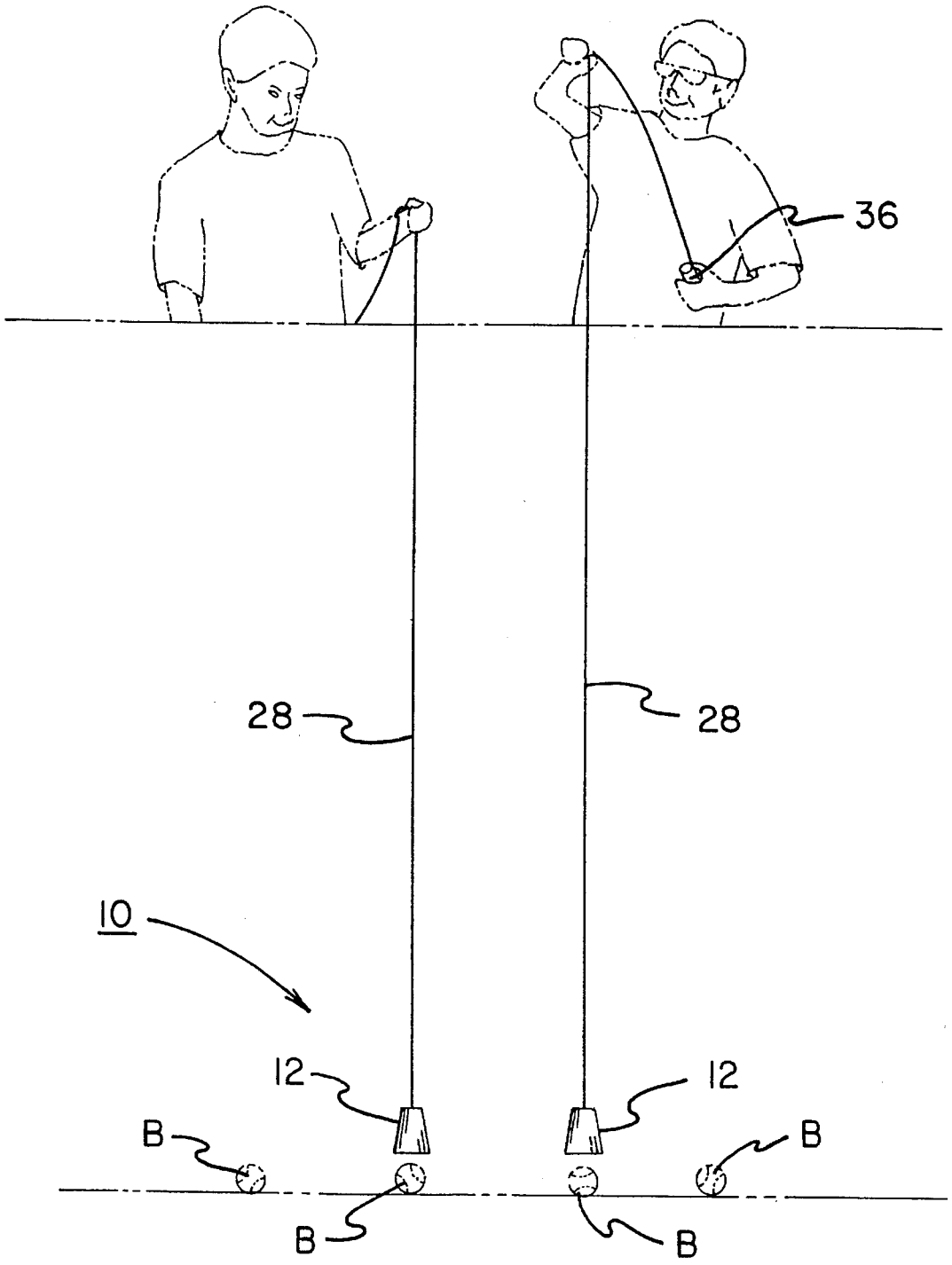
FIG. 1 is a perspective illustration of the preferred embodiment of the apparatus for retrieving baseballs constructed in accordance with the principles of the present invention.
Figure 2:
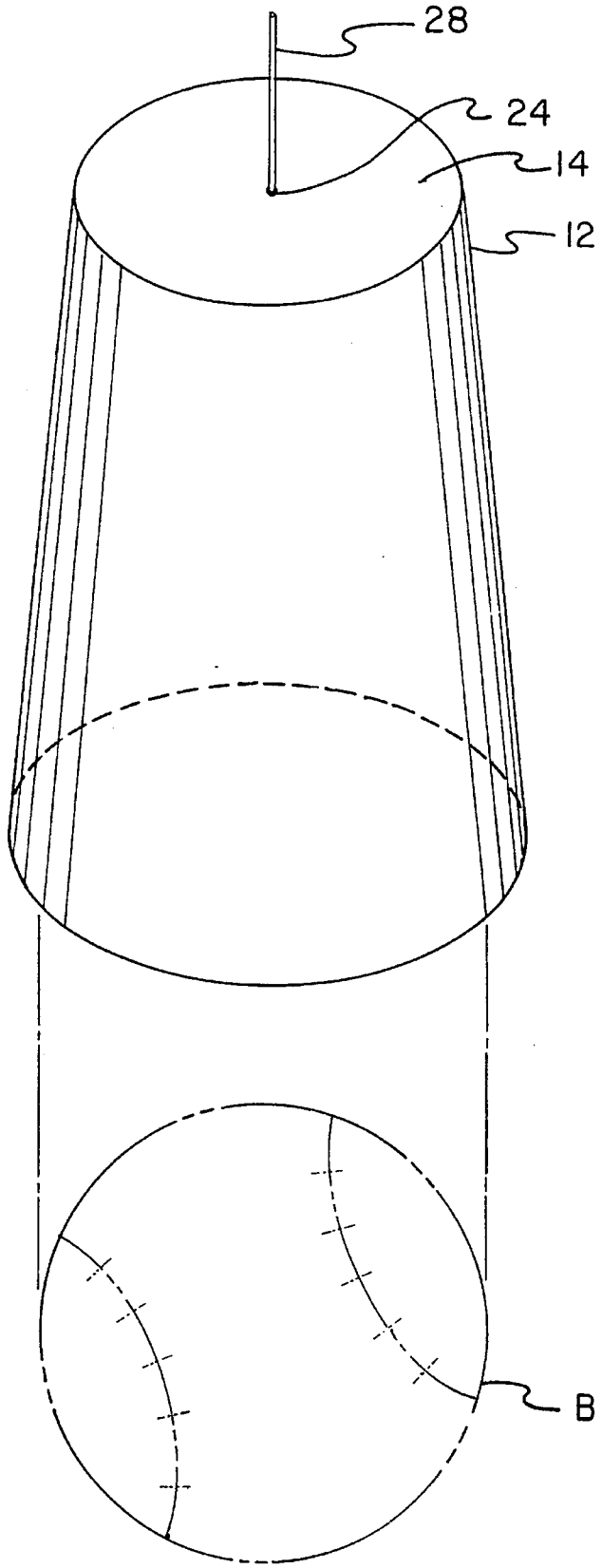
FIG. 2 is an enlarged perspective view of the cup, a portion of the string and the ball to be grasped and lifted thereby.
Figure 3:
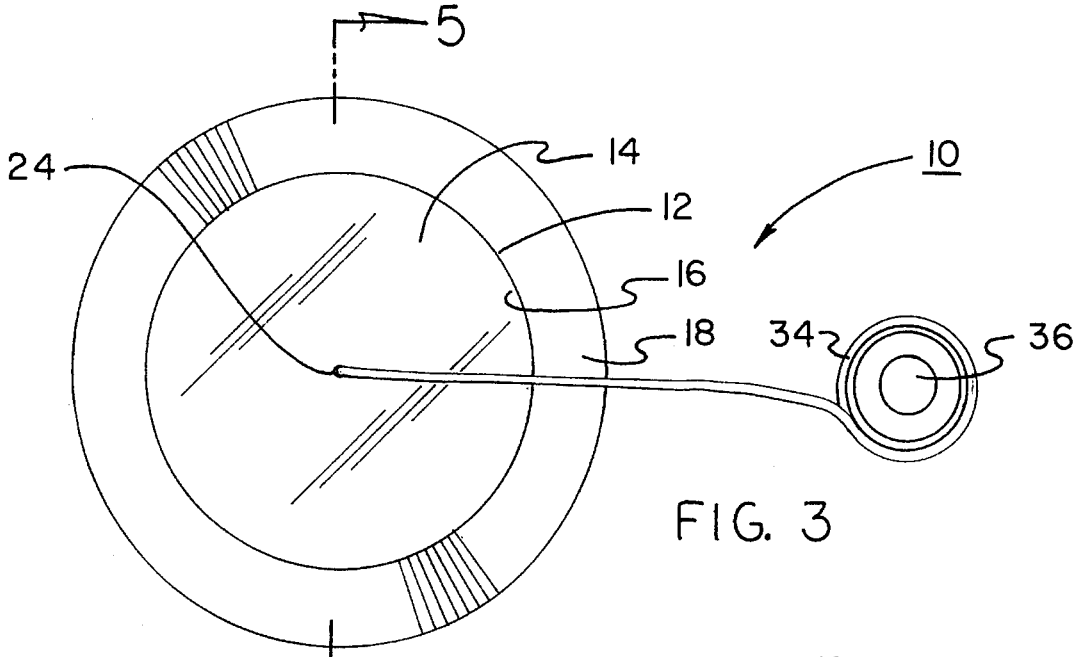
FIG. 3 is a top elevational view of the device shown in the prior Figures.
Figure 4:
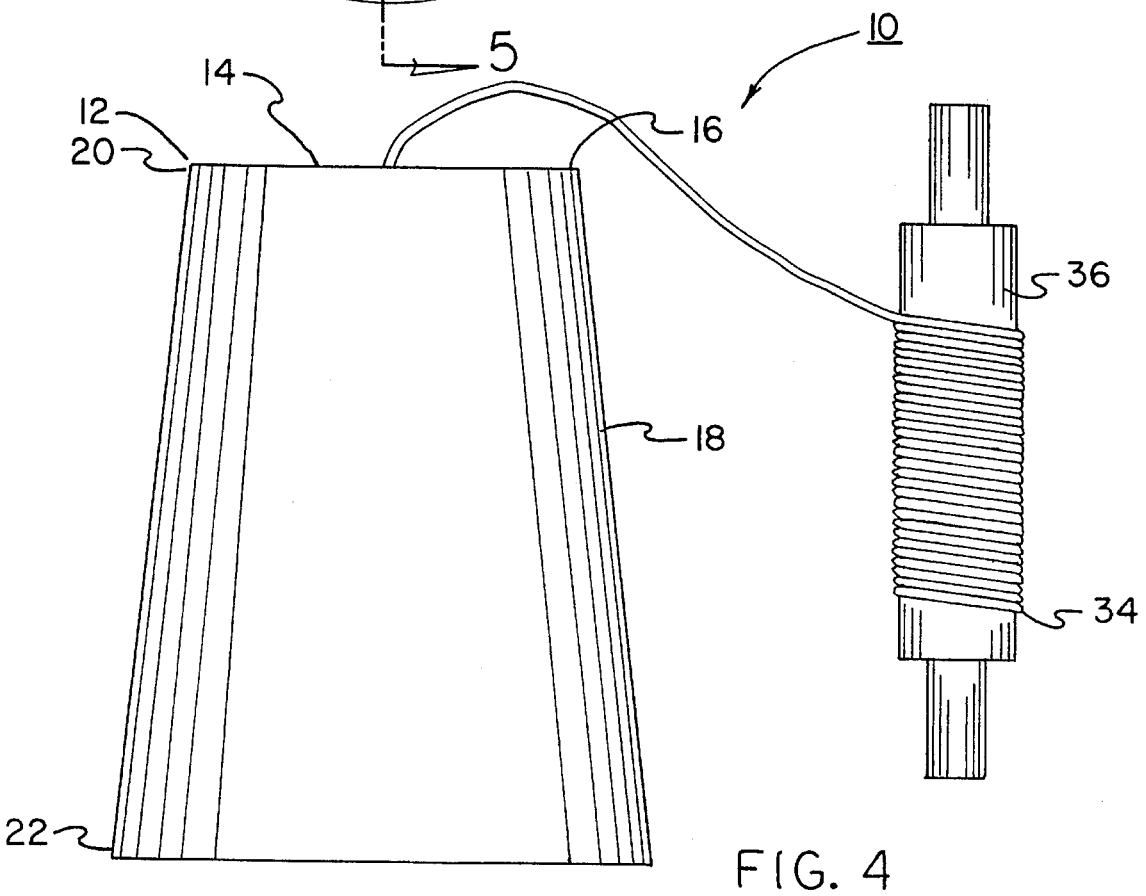
FIG. 4 is a front elevational view of the device shown in FIG. 3.

With reference now to the drawings, and in particular to FIG. 1 thereof, a new and improved apparatus for retrieving baseballs embodying the principles and concepts of the present invention and generally designated by the reference numeral 10 will be described.

The present invention, the new and improved apparatus for retrieving baseballs, is comprised of a plurality of components. Such components in their broadest context include a cup, a string, a handle, a weight and washers. Such components are individually configured and correlated with respect to each other so as to attain the desired objective.

The central component of the system 10 is a cup 12. The cup is formed with a base 14 of a circular cross sectional configuration. The base has a circular periphery 16 therearound. The cup also is formed with a frustro-conical side wall 18. The side wall is secured to the periphery of the base. Together the base and side wall form a closed smaller end 20 and an opened larger end 22.

The cup 12 is preferably fabricated of a plastic material. This gives limited resilience as will be needed during operation and use. The cup is formed with a diameter at the base of about 3 inches. At the open end, the diameter of the cup is about 4 inches. The cup has a height of about 6 inches. The side walls then form an angle of about 5 degrees when measured from the axis of the cup. All of such measurements in inches and degrees are plus or minus about 10 percent. The cup is also formed with a small aperture 24 at the center of the base. When a ball B is thus entrained and grasped by the cup, a small portion of the ball will extend downwardly from the lower edge of the cup and a central extent of the side wall of the cup will be in contact with the exterior periphery of the ball.

Next provided is a string 28. The string has a free end 30. The free end is positioned through the aperture in the cup when inverted. A knot 32 is formed in the free end of the string within the cup. The string also has a secured end 34.

Figure 5:
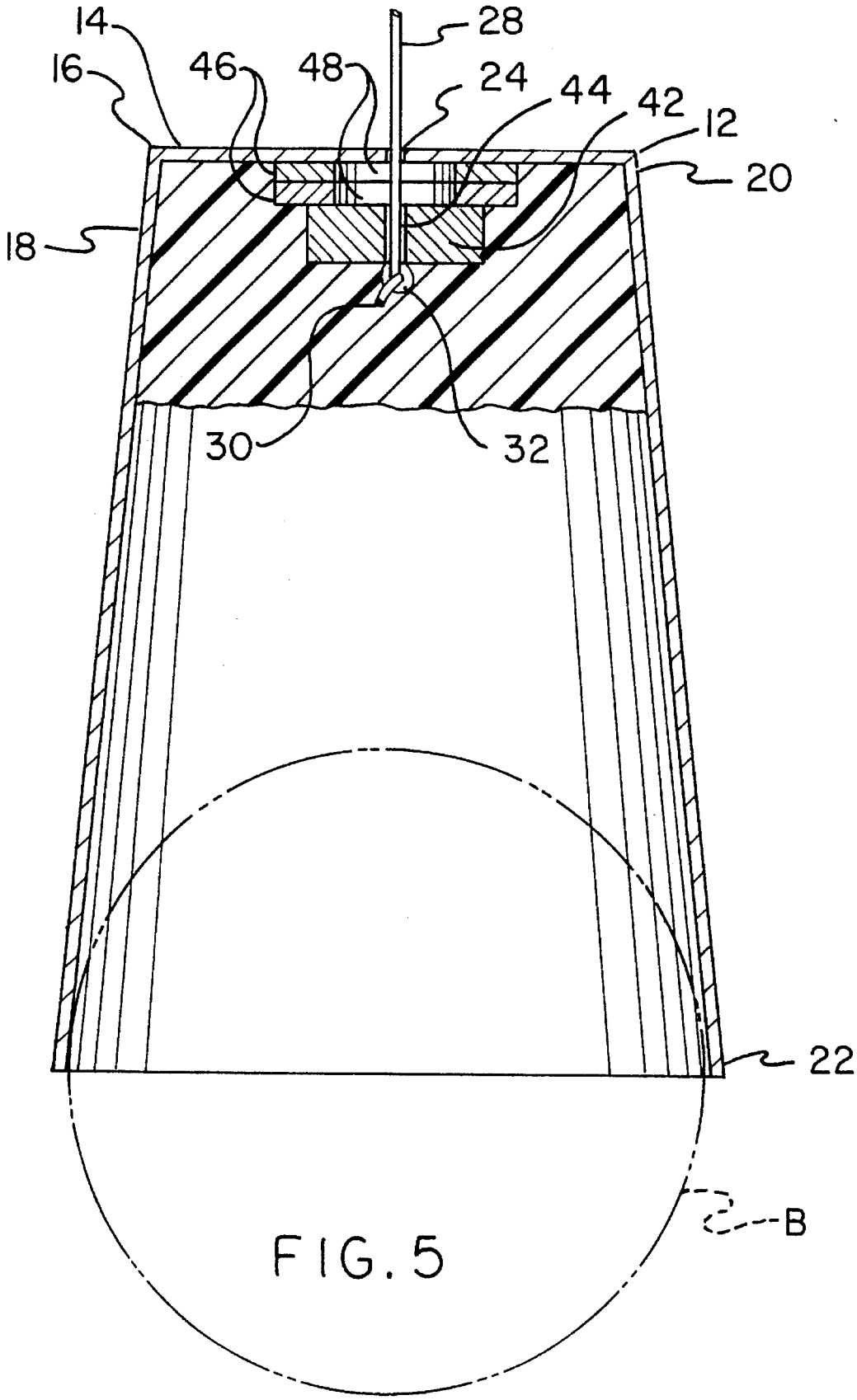
FIG. 5 is cross-sectional view taken along line 5—5 of FIG. 3.

The next component of the system 10 is a cylindrical handle 36. The handle has for its purpose the wrapping of the string therearound. The wrapping of the string 28 begins with a secured end therearound. An intermediate extent of the string may then be fed out from the handle to allow the free end of the string along with the knot and cup to be lowered by gravity over a baseball to be grasped. With the baseball so grasped as shown in FIG. 5, the string is rewrapped on the handle for retrieving the cup and ball.

Greater facility of the apparatus of the present invention is generated through the use of a weight 42. The weight is in a disk-shaped configuration with a hole 44 extending therethrough. The weight is positioned in proximity to the small aperture of the cup. It is located within the cup. In this manner, lifting the string will cause the string to engage the hole in the weight to lift the weight and the cup in anticipation of dropping the cup over the ball.

Lastly provided is a plurality of disk-shaped washers 46.

Each of the washers has a circular opening 48 therethrough. The washers are positioned between the weight and the base of the cup. In this manner, the combination of the weight and the washers add mass and weight to the cup. In this manner, when the cup is dropped over the ball, it will fall with greater velocity and force to make a more sure entrapment of the ball to be contacted thereby. This allows the ball to be more securely retrieved by the user.

This product offers baseball fans who are observing either batting practice or a game a way to retrieve stray baseballs that roll their way. On most fields, the playing surface is too low for a fan to reach over the restraining wall in the outfield and grab a baseball that is hit out there. With this device, however, such a ball can be trapped inside the paper cup and pulled in, much as a fish is reeled in by an angler.

The present invention is made from a cup with a mouth slightly larger than the diameter of a baseball. The opening of the cup should get gradually narrower. Thus, the ball is easily wedged in the opening.

The cup is modified as follows: First, a hole is made in the center of the bottom of the cup. A few washers and a small, egg-shaped fishing weight are glued over the hole. A string is threaded through the hole in the cup, as well as through the washers and the weight. Finally, the cup is filled roughly one third of the way with auto body filler or fiberglass resin. The device is now ready for use.

When a baseball rolls out to the outfield wall, the user lets down the cup, in upside down position, until it is positioned just above the ball. Drop the cup on the ball from a height of three or four inches. This should be sufficient to cause the ball to stick in the cup while you happily reel in your souvenir. For anyone who has ever wished they could reach that ball down below, the present invention is an ideal product.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for retrieving baseballs, comprising, in combination:

a cup, the cup having a base with a periphery and a frustro-conical side wall secured to the periphery, to thereby form a closed smaller end and an opened larger end, the cup being fabricated of a plastic material with limited resilience and with a diameter at the base of two inches, a diameter at the open end of three inches, and having a height of about six inches whereby the side wall forms an angle of about five degrees when measured from the axis of the cup, such measurements being plus or minus 10 percent, the cup being formed with a small aperture in the center of the base;

a string having a free end positioned through the aperture in the cup when inverted and a knot formed in the free end within the cup, the string also having a secured end;

a cylindrical handle for the wrapping of the string, the wrapping of the string beginning with the secured end and an intermediate extent thereof for feeding out string to allow the free end of the string, the knot and cup to be lowered by gravity over a baseball and then re-wrapped on the handle for retrieving the cup and baseball;

a weight having a hole therethrough positioned in proximity to the small aperture of the cup within the cup whereby lifting the string will cause the string to engage the hole in the weight to lift the weight and the cup; and a plurality of disk-shaped washers with circular openings therethrough positioned between the weight and the base of the cup.

2. An apparatus for retrieving baseballs, comprising:

a cup having a base with a periphery and a frustroconical side wall secured to the periphery to thereby form a closed smaller end and an opened larger end, the cup being fabricated of a plastic material with limited resilience and with a diameter at the base of three inches, a diameter at the open end of four inches, and having a height of about six inches whereby the side wall forms an angle of five degrees when measured from the axis of the cup, such measurements being plus or minus 10 percent, the cup being formed with a small aperture in the center of the base;

a string having a free end positioned through the aperture in the cup when inverted and a knot formed in the free end within the cup, the string also having a secured end;

a cylindrical handle for the wrapping of the string, the wrapping of the string beginning with the secured end and an intermediate extent thereof for feeding out string to allow the free end of the string, the knot and cup to be lowered by gravity over a baseball and then re-wrapped on the handle for retrieving the cup and baseball;

a weight having a hole therethrough positioned in proximity to the small aperture of the cup within the cup whereby lifting the string will cause the string to engage the hole in the weight to lift the weight and the cup; and a plurality of disk-shaped washers with circular openings therethrough positioned between the weight and the base of the cup.

* * * * *